United States Patent [19]

Zenzaburo

[11] 4,177,790

[45] Dec. 11, 1979

[54] POCKET CAMP STOVE

[75] Inventor: Iwamoto Zenzaburo, Yokohama, Japan

[73] Assignee: International Business Development Co., Bellevue, Wash.

[21] Appl. No.: 861,863

[22] Filed: Dec. 19, 1977

Related U.S. Application Data

[62] Division of Ser. No. 704,119, Jul. 12, 1976, Pat. No. 4,092,974.

[51] Int. Cl.[2] ..... F24C 5/20

[52] U.S. Cl. ..... 126/38; 126/9 B; 126/9 R; 126/40; 431/344

[58] Field of Search ..... 126/38, 40, 9 R, 9 B; 431/344

[56] References Cited

U.S. PATENT DOCUMENTS

| | | | |
|---|---|---|---|
| 2,325,077 | 7/1943 | Robinson | 126/38 |
| 2,331,931 | 10/1943 | Robinson | 126/38 |
| 2,447,925 | 8/1948 | Vorbusch | 126/40 |
| 2,733,907 | 2/1956 | Phillips | 126/40 |
| 2,857,905 | 10/1958 | Vanderbeek | 128/38 |
| 3,608,538 | 9/1971 | Guerrero | 126/38 |
| 3,648,680 | 3/1972 | Hein | 126/38 |
| 3,794,013 | 2/1974 | Upton | 126/40 |
| 3,809,054 | 5/1974 | Bowman | 126/38 |

*Primary Examiner*—Samuel Scott
*Assistant Examiner*—Daniel J. O'Connor
*Attorney, Agent, or Firm*—Delbert J. Barnard

[57] ABSTRACT

Three wire leg members are attached to a relatively small hub member and are movable between a folded position in which all three leg members are relatively together and an in use position in which the three leg members are substantially equally spaced apart and extend radially outwardly from the hub member. A gas burner unit is received within an upwardly directed recess formed in the hub member and includes an upwardly directed burner head. The wire leg members have lower portions restable on a support surface and upper portions providing a pan support at a level above the burner head. A flexible hose extends from the burner unit to a control valve and adaptor assembly attachable to the top of a can of butane gas. The control valve includes a knob and means controlled by rotation of the knob for moving a depressable member which is a part of an outlet valve built into the can, for both turning the gas flow on and off and regulating its flow rate.

4 Claims, 4 Drawing Figures

POCKET CAMP STOVE

This is a division, of application Ser. No. 704,119, filed July 12, 1976, now U.S. Pat. No. 4,092,974.

BACKGROUND OF THE INVENTION

1. Field of the Invention

This invention relates to small gas stoves for outdoorsmen, and in particular to such a stove which is foldable into a compact, pocket-size package.

2. Description of the Prior Art

Various types of small stoves have been proposed and/or marketed for use by campers and other outdoorsmen. However, the known stoves of this type do not satisfy the need for a stove which is extremely simple in construction, is easy to assemble and use, and when not in use can be collapsed and stored in a quite small pocket shape storage space. It is the primary object of this invention to provide a lightweight pocket size camp stove which fulfills this need.

SUMMARY OF THE INVENTION

The portable gas stove of this invention is basically characterized by a burner support hub member; a plurality of leg members which are connected to the hub member, each of which includes a lower foot portion restable on a support surface and an upper pan supporting portion; and a gas burning unit positionable on the support hub. The gas burner unit includes a burner head which extends upwardly from said hub to a level below the level of the pan supporting portions of the legs. A gas supply conduit is connected to the burner unit and extends therefrom to a connector which is especially adapted for connecting it to a can of gaseous fuel under pressure of a type having a depressable member controlled outlet valve built into the can. The connector includes a valve means which is operable for moving the depressable member a selected amount for both turning the gas flow on and off and regulating its flow rate.

According to an aspect of the invention, the connector comprises a first adapter member which is attachable to an upper portion of a can of gaseous fuel of the type described. Such member includes an upstanding, externally threaded tubular stem that, when said member is installed on a can of gaseous fuel, is generally concentric with the depressable control member of the outlet valve built into the can and such depressable control member projects upwardly into the interior of the tubular stem. The connector also includes a second member in the form of a rotatable control cap having internal threads matable with the external threads of the stem. A third member is affixed to the end of the flexible hose and includes a socket for engaging the depressable member on the can. The rotatable control cap is rotatable about the third member but is otherwise fixed in position relative to the third member. As a result of this arrangement, when the control cap is rotated in the direction causing it to screw itself onto the threads on the stem of the first member it causes the third member to be moved axially inwardly to contact and depress the depressable member. The control cap is rotatable between an off position in which the third member does not depress the depressable member enough to cause any flow of gas out from the can to a fully open position in which the depressable member is substantially fully depressed and there is a maximum flow of gas out from the can.

According to another aspect of the invention, each leg member is formed from a piece of wire and comprises a first end portion which is insertable into a lower socket formed for it in the hub member, and said leg member extends downwardly from said end portion to form a lower foot portion, and from said lower foot portion extends upwardly to form an upper pan supporting portion, and then extends downwardly to a second end portion which is received within an upper socket formed for it in the hub member. The two end portions of each wire leg member function as trunnions, so that the leg members can be folded between a stowage position in which all of the leg members are relatively together and an in use position in which the leg members are spaced apart and extend substantially radially outwardly from the hub member.

These and other features, objects and advantages of the invention will be apparent from the preferred embodiment which is illustrated in the drawing and described below.

BRIEF DESCRIPTION OF THE DRAWING

In the drawing like element designations refer to like parts, and

DESCRIPTION OF THE PREFERRED EMBODIMENT

Figure 1:
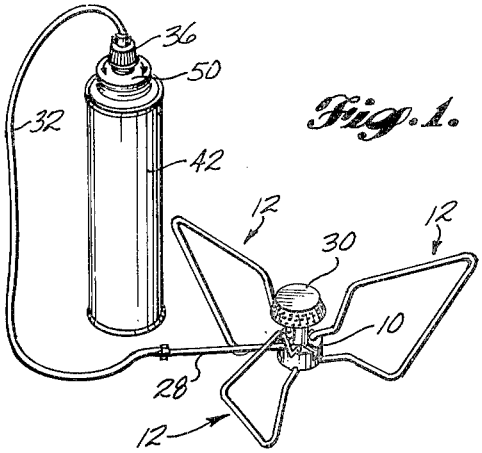
FIG. 1 is an isometric view of an embodiment of the invention in its operative condition.
Figure 2:
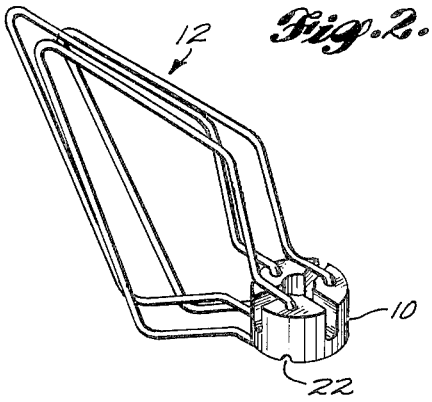
FIG. 2 is an isometric view of the hub member and leg assembly, showing the legs folded.
Figure 3:
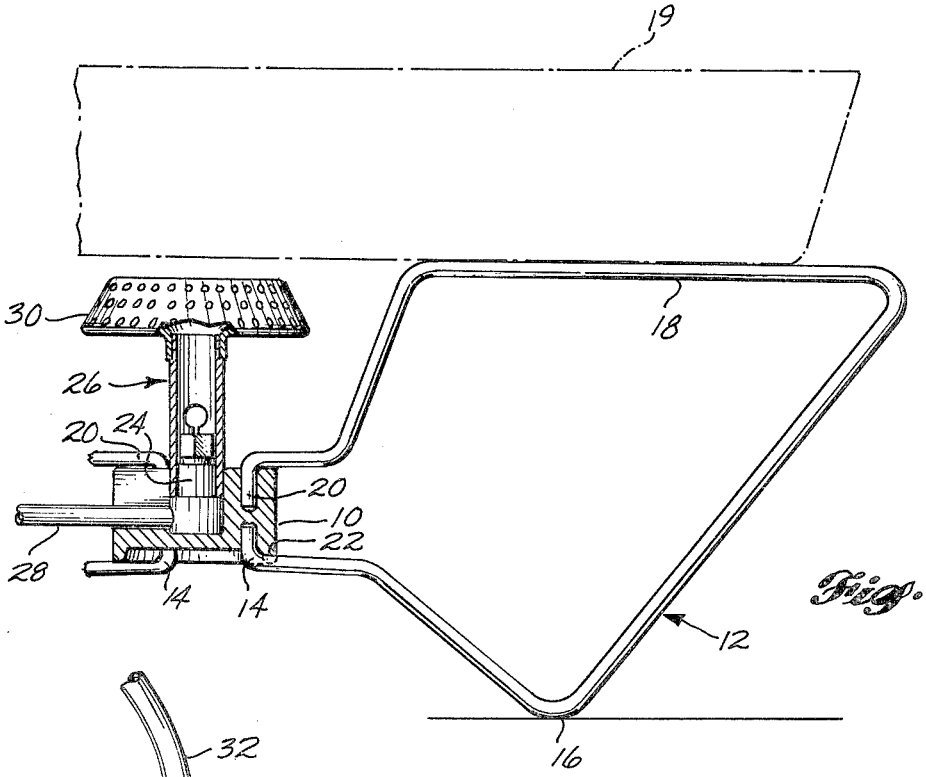
FIG. 3 is a fragmentary elevational view of the stove, showing one leg and the burner head in elevation and the hub member in vertical section.
Figure 4:
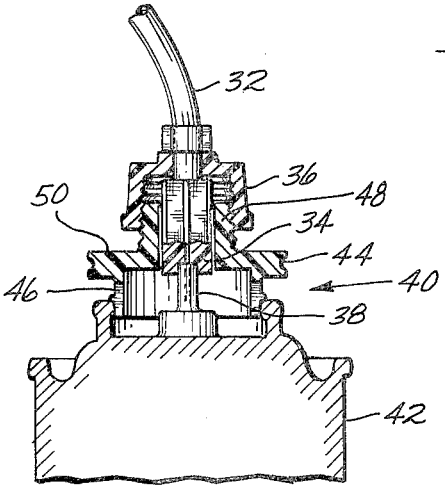
FIG. 4 is a vertical section view of the control valve and adapter assembly.

Referring to the drawing more specifically, the stove is shown to comprise a hub member 10 to which a plurality of leg members 12 are connected. Each leg member 12 includes a first end portion 14 which extends generally vertically and is insertable into a lower socket formed for it in a portion of the hub member 10. The wire forming the leg member 12 extends from end portion 14 first laterally and then downwardly to form a support foot 16, and from said support foot 16 extends upwardly and outwardly to the outward end of a generally horizontal pan support portion 18. FIG. 3 includes a broken line showing a pan 19. The wire then extends from the inner end of the pan support portion 18 both inwardly and downwardly to a second end portion 20 which extends into a socket formed for it in the upper portion of hub member 10. The two end portions 14, 20 and the two sockets therefore are axially aligned, and serve to mount the leg member 12 for rotation between a folded position and an in use position. When they are in their in use positions the leg members 12 are substantially evenly spaced apart and extend substantially radially outwardly from the hub member 10. Hub member 10 may be formed to include a lock notch 22 which is in position to engage the wire member. However, this construction allows the leg members 12 to be easily moved angularly in position out from engagement with the notches. The wire snaps into and out from the notches. When in their folded condition, all of the leg members are relatively close together, as shown by FIG. 2. The hub member 10 is formed to include an upwardly directed recess which receives a base portion 24 of a burner unit 26. The recess also includes three circumferentially spaced, upwardly directed transverse slots for selectively receiving the inner portion of an inlet stem 28. The burner unit 26 includes a burner head 30 which is quite conventional in construction and is adapted to mix atmospheric air with a gaseous fuel to form a combustable mixture.

A flexible fuel supply hose 32 is attached to the outer end of the inlet pipe 28. At its end opposite inlet pipe 28 the hose 32 is attached to a tubular member 34. A control knob or cap member 36 is mounted onto hose 32 for rotation in position about member 34. However, members 34, 36 are fixed in position axially. The member 34 includes an axial central passageway which is a continuation of the passageway through hose 32. The end part of the passageway forms a socket for receiving the upper end portion of a depressable control member 38 which is a portion of an outlet valve mechanism 40 built into the fuel can 42. The depressable member 38 includes an axial passageway through which the gaseous fuel flows when leaving the can 42. Opening and closing of this passageway is controlled by movement of the member 38. The valve mechanism is constructed so that the flow rate of the gaseous fuel out from can 42 is proportional to the amount of depression of control member 38.

The stove includes an adapter member 44 having a base portion 46 which is preferably plug fitted onto the upper portion of can 42. That is to say, it includes a lower tubular neck portion which is sized to slip onto and frictionally engage an upper portion of the can 42. Member 44 includes an upstanding externally threaded tubular stem 48. When member 44 is positioned on can 42, the depressable control member 39 projects upwardly part way into the interior of the stem 48. Control cap includes internal threads which are matable with the external threads on stem 48. As will be appreciated, rotation of the control cap 36 in the clockwise direction will cause the control cap to move axially downwardly relative to stem 48. This causes member 34 to also move axially downwardly and as it moves it depresses the valve member 38. The member 44 may be provided with indicia on its upper surface 50 for indicating an off position (in which member 38 is not depressed at all) and a fully open position (in which member 38 is fully depressed).

The burner is prepared for use in the following manner. The base assembly comprising the hub member 10 and the leg member 12 is removed from the storage pocket. The leg members 12 are swung apart until they snap into the notches 22. Then the several pieces of the burner assembly are attached together and the base portion of the burner assembly, and the inlet pipe 28, are set downwardly, into the recess formed in hub member 10. Next, adapter member 44 is snap fitted onto the top of the fuel can 42. Then, control cap is loosely joined with the stem 48. The camp stove is now ready to be burned on in the following manner. With the stove set up on a substantially level surface, a lighted match is held next to the burner head 30 and the control cap 36 is turned clockwise until the burner lights. The control cap 36 is then turned an additional amount while watching the flame until a substantial body of flame is present. Care must be taken to maintain the fuel can 42 spaced away from the flame and in an upright position. The heat ranges from simmer to about sixteen hundred degrees Farenheit (1,600° F.) and may be regulated by the control cap 36.

The stove is prepared for packing by first turning the control cap 36 counterclockwise until the flame is extinguished. Then, the stove is allowed to cool for about five minutes or more. In the meantime, the control cap 36 is completely removed from stem 48 and the adapter member 44 is removed from the fuel can 42. Following sufficient cooling, the burner members 24, 28, 30 are removed from the support head 10. The hose 32 may be formed into a coil adjacent the inlet pipe for stowage adjacent the hub member 10 and the leg member assembly 12 when in its folded condition. The legs 12 are then swung inwardly together to their folded position. Then, this assembly of hub member 10 and legs 12, and the other components 18, 24, 28, 30, 32, 34, 36, 44 may be placed back into their storage packet.

The stove can be fueled by an eight fluid ounce can of butane gas or the like of the type which is marketed for use in filling cigarette lighters, etc.

What is claimed is:

1. A knock-down portable gas stove comprising:

a burner support hub member including a vertical socket;

a plurality of leg members, each of which is pivotally connected to the hub member for pivotal movement about a vertical axis between a use position wherein each of the legs extends radially outwardly from the hub member and a stowage position wherein each of the leg members are disposed substantially against the other leg members in a relatively flat, juxtaposed relationship;

each of the leg members including a lower foot portion restable on a support surface and an upper pan support portion;

a gas burner unit insertable into the socket in the support hub member and including a burner head positioned above the hub member at a level below the level of the pan supporting portions of the leg members; and a gas supply conduit having an outlet end connected to the burner unit and an inlet end adapted to receive gaseous fuel from a remote, volumetrically regulated source of gaseous fuel under pressure;

whereby said knock-down portable gas stove can be disassembled for easy, compact stowage in a relatively flat configuration by removing the burner unit from the socket in the hub member, by folding the leg members relatively together, and by placing the burner unit and the gas supply conduit adjacent the folded leg members and the hub member.

2. The knock-down portable gas stove of claim 1, wherein the gas burner unit includes a tubular stem portion supported by and extending upwardly from the hub member during use and wherein the burner head is slideably removeably carried by the upper portion of stem portion of the gas burner unit, whereby the stowage of the knockdown portable gas stove in a compact, relatively flat configuration is enhanced by permitting the burner head to be removed from the stem portion of the gas burner unit and by placing the burner head adjacent the folded leg members and hub member.

3. A knock-down portable gas stove according to claim 1, wherein the burner unit includes a generally cylindrical base portion and an inlet pipe extending generally transversely with respect thereto, and wherein the socket in the hub member includes a generally cylindrical cavity substantially centered in the hub member which receives the generally cylindrical base portion of the burner unit, and further includes an upwardly directed transverse slot which receives the inlet pipe of the burner unit.

4. A knock-down portable gas stove according to claim 1, or 3 wherein the gas supply conduit includes a flexible hose portion; whereby the stowage of the knock-down portable gas stove in a compact, relatively flat configuration is enhanced by forming the flexible hose portion of the gas supply conduit into a coil and placing it adjacent the folded leg members and the hub member.

* * * * *